US007806400B2

(12) United States Patent
Fukusaka

(10) Patent No.: US 7,806,400 B2
(45) Date of Patent: Oct. 5, 2010

(54) IMAGE FORMING APPARATUS

(75) Inventor: Tetsuro Fukusaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 622 days.

(21) Appl. No.: 11/748,354

(22) Filed: May 14, 2007

(65) Prior Publication Data

US 2007/0262513 A1 Nov. 15, 2007

(30) Foreign Application Priority Data

May 15, 2006 (JP) ..... 2006-135893

(51) Int. Cl.
*B65H 3/34* (2006.01)
*B65H 3/14* (2006.01)
*B65H 7/02* (2006.01)

(52) U.S. Cl. ..... 271/104; 271/97; 271/265.04

(58) Field of Classification Search ..... 271/97, 271/90, 108, 104, 262, 260, 265.04
See application file for complete search history.

(56) References Cited

U.S. PATENT DOCUMENTS 5,088,713 A * 2/1992 Hayashi ..... 271/3.03
5,348,286 A * 9/1994 Buck ..... 271/263
5,645,274 A 7/1997 Ubayashi
5,848,789 A * 12/1998 Ochi et al. ..... 271/258.01
6,595,510 B2 * 7/2003 Kayani ..... 271/10.03
6,669,186 B2 * 12/2003 Tunink et al. ..... 271/9.11
6,672,587 B1 * 1/2004 Mohringer et al. ..... 271/259
7,384,040 B2 * 6/2008 Tunink et al. ..... 271/262
2005/0264636 A1 * 12/2005 Takito et al. ..... 347/104
2007/0045933 A1 * 3/2007 Okazaki ..... 271/104

FOREIGN PATENT DOCUMENTS

JP 7-196187 8/1995
JP 2004-051287 2/2004
JP 2004051287 * 2/2004
JP 2004-331258 11/2004

* cited by examiner

*Primary Examiner*—Patrick Mackey
*Assistant Examiner*—Patrick Cicchino
(74) *Attorney, Agent, or Firm*—Canon USA Inc IP Div

(57) ABSTRACT

A loosening fan provided in an air blowing unit blows at sheets stacked on a tray to loosen the sheets. When, during a sheet feeding operation, a multi-feed detection unit detects a multi-feed condition, the loosening fan is controlled such that an air pressure that enables the sheets to be loosened is obtainable. Therefore, the occurrence of multi-feed conditions can be reduced.

10 Claims, 17 Drawing Sheets

FIG. 5A

FOR ONE FAN WITH PWM 100%

| | (Hz) |
|---|---|
| ROTATION FREQUENCY | 600 |

⇨ 1000 Pa

FIG. 5B

FOR ONE FAN WITH SPEED CONTROL TO TARGET VALUE

| | (Hz) |
|---|---|
| TARGET VALUE | 500 |
| UPPER LIMIT OF TARGET VALUE | 502 |
| LOWER LIMIT OF TARGET VALUE | 498 |

⇨ 840 Pa IS ACHIEVED

⇨ PWM = 90%

FIG. 5C

FOR FOUR FANS WITH SPEED CONTROL TO TARGET VALUE

| | | (Hz) |
|---|---|---|
| FIRST FAN | TARGET VALUE | 182 |
| | UPPER LIMIT OF TARGET VALUE | 184 |
| | LOWER LIMIT OF TARGET VALUE | 180 |
| SECOND FAN | TARGET VALUE | 171 |
| | UPPER LIMIT OF TARGET VALUE | 173 |
| | LOWER LIMIT OF TARGET VALUE | 169 |
| THIRD FAN | TARGET VALUE | 181 |
| | UPPER LIMIT OF TARGET VALUE | 183 |
| | LOWER LIMIT OF TARGET VALUE | 179 |
| FOURTH FAN | TARGET VALUE | 162 |
| | UPPER LIMIT OF TARGET VALUE | 164 |
| | LOWER LIMIT OF TARGET VALUE | 160 |

⇨ 840 Pa IS ACHIEVED

IMAGE FORMING APPARATUS

BACKGROUND OF THE INVENTION

1. Field of the Invention

The present invention relates to image forming apparatuses, and in particular, to an image forming apparatus that feeds a sheet after loosening stacked sheets by blowing air on the sheets.

2. Description of the Related Art

Some image forming apparatuses, such as copiers and printers, each have a sheet feeding device that consecutively separates the topmost sheet from a sheet stack on a sheet stacking unit and feeds the sheet to an image forming unit.

One such sheet feeding device is disclosed in U.S. Pat. No. 5,645,274. The sheet feeding device blows air on a sheet stack on a sheet stacking unit, causes several sheets to be lifted, separates one sheet from the other sheets, and then feeds the sheet while causing the sheet to be held on a suction conveying belt by suction.

FIG. 13 illustrates the structure of such a sheet feeding device, which separates a sheet from a sheet stack by using air and then feeds the sheet while causing the sheet to be held on a suction conveying belt by suction.

In FIG. 13, an image forming apparatus includes a repository 11 for storing sheets S, the repository 11 being slidably movable on a main body (not shown) thereof. The repository 11 is provided with a raisable and lowerable tray 12 for accommodating the plurality of sheets S thereon and a rear-end regulator 13 for regulating the position of an upstream end of the sheets S in a sheet feed direction, i.e., the rear end. The repository 11 is also provided with side-end regulators 14 and 16 and a slide rail 15 used for sliding the repository 11 outward from the main body of the image forming apparatus. The side-end regulators 14 and 16 regulate ends of the sheets S in a width direction, which is substantially perpendicular to the sheet feed direction, i.e., the side ends of the sheets S.

A suction conveying belt 21 is configured to feed a sheet while holding the sheet by suction. A suction fan 36 is configured to cause one of the sheets S to be held on the suction conveying belt 21 by suction. A suction shutter 37 is disposed within a suction duct 38. An air blowing unit 30 is configured to blow air on a downstream (front) end of a sheet stack SA in the sheet feed direction, i.e., the leading-end face. The air blowing unit 30 includes a separation fan 31, a separation duct 32, a loosening nozzle 33, and a separation nozzle 34.

For a sheet feeding device that has the above described structure, after a user draws the repository 11 out, places the sheets S thereon, and returns the repository 11 into the main body, the tray 12 is raised by a driving unit (not shown) in a direction indicated by an arrow A, as illustrated in FIG. 14. The tray 12 stops at a position where the distance between the top surface of the sheet stack SA and the suction conveying belt 21 is B and waits for reception of a feed signal.

In response to an input of a feed signal, the separation fan 31 starts operating and takes in air in a direction indicated by an arrow C, as illustrated in FIG. 15. The air passes through the separation duct 32 and is blown on the leading-end face of the sheet stack SA from the loosening nozzle 33 and the separation nozzle 34 in directions indicated by arrows D and E, respectively. Then, several sheets Sa among the sheet stack SA are lifted, so that the sheet stack SA is loosened. The suction fan 36 starts operating and discharges air in a direction indicated by an arrow F, as illustrated in FIG. 15. At this time, the suction shutter 37 provided in the suction duct 38 is closed.

The side-end regulators 14 and 16 are provided with auxiliary separation fans 17 and 18, respectively. Air from the auxiliary separation fans 17 and 18 is blown on the side ends of the sheet stack SA through openings 14A and 16A. The provision of the auxiliary separation fans 17 and 18 can lift the sheets Sa to loosen the sheet stack more reliably.

When a predetermined period of time has elapsed from the input of the feed signal and the lift of the sheets Sa has become stable, the suction shutter 37 is rotated in a direction indicated by an arrow G, as illustrated in FIG. 16. Thus, the suction fan 36 produces a negative pressure within the suction duct 38, and a sucking force is generated in a direction indicated by an arrow H through suction holes (not shown) of the suction conveying belt 21. Thus, the topmost sheet Sb of the sheets Sa is held on the suction conveying belt 21 by suction.

Lastly, a belt driving roller 41 is rotated in a direction indicated by an arrow J, as illustrated in FIG. 17, thereby feeding the sheet Sb in a direction indicated by an arrow K together with the rotation of the suction conveying belt 21. Subsequently, the sheet Sb is conveyed to a next conveying path by a pair of drawing rollers 42 rotating in directions indicated by arrows M and P.

In such a sheet feeding device (air sheet feeding device), along the subsequent conveying path, a multi-feed detection unit 43 for detecting a multi-feed condition (a situation in which a plurality of stacked sheets are conveyed at a time) is disposed above and below the subsequent conveying path. The multi-feed detection unit 43 includes, for example, two ultrasonic sensors for transmitting and receiving ultrasonic waves. The multi-feed detection unit 43 is configured to detect whether a multi-feed situation is occurring on the basis of a reception level of ultrasonic waves that are irradiated through one or more sheets passing through the conveying path.

Japanese Patent Laid-Open No. 2004-051287 discloses a technique for reliably loosening sheets by, when a multi-feed condition is detected by a multi-feed detection unit, controlling the quantity of air supplied by an air blowing unit to increase temporarily.

Japanese Patent Laid-Open No. 2004-331258 discloses a technique for reliably loosening sheets by counting the number of occurrences of a multi-feed condition and, if that number reaches a predetermined value, changing the setting of the air blowing unit so that the quantity of air is increased.

These known techniques preset the quantity of air blown from the air blowing unit at a plurality of stages and, if a multi-feed condition is detected or if the number of occurrences of a multi-feed condition reaches a predetermined value, controls the quantity of air to be increased by one stage. In addition, the techniques control the quantity of air to return to the initial setting when one job is completed.

Unfortunately, for these structures, when a multi-feed condition is caused by rotation of a fan for blowing air with an inappropriate rotation frequency, the quantity of air is simply increased in stages. Therefore, the quantity of air does not become appropriate in most cases, so a multi-feed problem is not fully solved. In addition, since the quantity of air returns to the initial setting upon completion of a job, a multi-feed condition tends to occur again when a next job that is to convey the same kind of sheets begins.

SUMMARY OF THE INVENTION

The present invention is directed to an image forming apparatus that can reliably prevent a plurality of sheets from being conveyed at a time.

According to one aspect of the present invention, an image forming apparatus includes a tray, an image forming unit, and a sheet feeding device. The sheet feeding device is configured to feed a sheet to the image forming unit after loosening sheets stacked on the tray by blowing air on the sheets. The sheet feeding device includes an air blowing unit that has a fan for blowing air on the sheets stacked on the tray and a multi-feed detection unit configured to detect a multi-feed condition in which a plurality of sheets are fed at a time. The sheet feeding device is configured to adjust a rotation frequency of the fan in response to detection performed by the multi-feed detection unit and to control the fan to rotate at the adjusted rotation frequency for a feeding job subsequent to a feeding job associated with the detected multi-feed condition.

Further features of the present invention will become apparent from the following description of exemplary embodiments (with reference to the attached drawings).

BRIEF DESCRIPTION OF THE DRAWINGS

FIGS. 5A to 5C show rotation-speed control for the loosening fan illustrated in FIG. 2.

DESCRIPTION OF THE EMBODIMENTS

Figure 1:
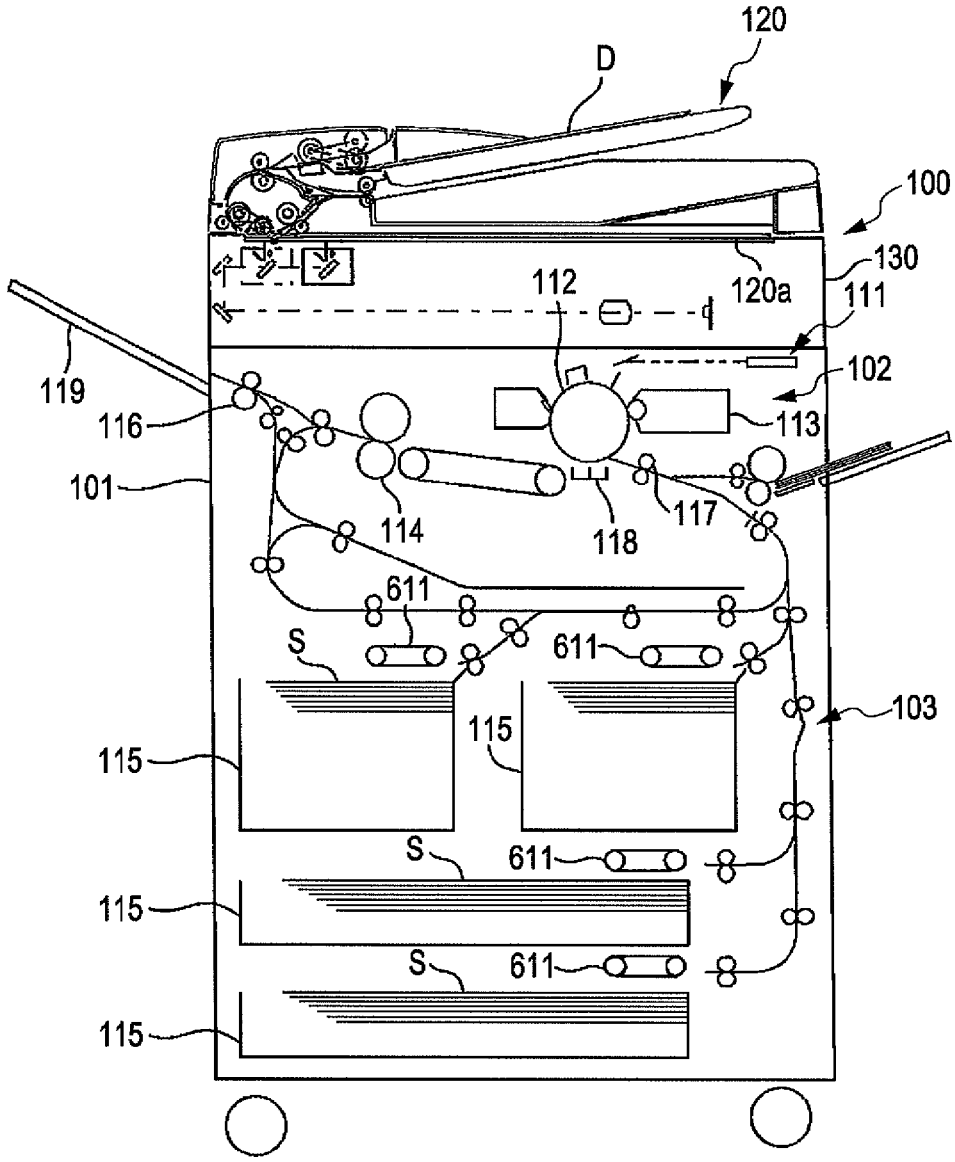
FIG. 1 illustrates a schematic structure of a printer that is one example of an image forming apparatus according to a first embodiment of the present invention.

The best mode for carrying out the present invention will be described below with reference to the drawings. FIG. 1 illustrates a schematic structure of a printer that is one example of an image forming apparatus according to a first embodiment of the present invention.

In FIG. 1, a printer 100 includes a printer main body (hereinafter referred to as main body) 101. An image reading unit 130 for reading a document D placed on a platen glass 120*a*, functioning as a document placement table, supplied by an automatic document feeder 120 is disposed on the main body 101. An image forming unit 102 and a sheet feeding device 103 for feeding one of sheets S to the image forming unit 102 are disposed below the image reading unit 130.

The image forming unit 102 includes a photosensitive drum 112, a developing unit 113, and a laser scanning unit 111. The sheet feeding device 103 includes a plurality of sheet storage units 115 for accommodating the sheets S (e.g., overhead transparency (OHT)) and a suction conveying belt 611, which is a sheet feeding unit, for extracting one of the sheets S from each of the sheet storage units 115 and conveying the sheet S. The sheet storage unit 115 is removable from the main body 101.

Next, an image forming operation performed by the printer 100 having the above-described structure will be described below. When an image reading signal is output from a controller (not shown) provided in the main body 101 to the image reading unit 130, the image reading unit 130 reads an image. Then, the laser scanning unit 111 emits laser light corresponding to that electrical signal, and the photosensitive drum 112 is radiated with the laser light.

The photosensitive drum 112 is charged in advance. Causing the photosensitive drum 112 to be radiated with light forms an electrostatic latent image on the photosensitive drum 112. The electrostatic latent image is then developed by the developing unit 113, and thus a toner image is formed on the photosensitive drum 112.

When a paper feed signal is output from the controller to the sheet feeding device 103, the sheet S is supplied from the sheet storage unit 115. Subsequently, the fed sheet S is transmitted to a transfer unit constituted of the photosensitive drum 112 and a transfer charger 118 via a registration roller 117 in synchronism with the toner image on the photosensitive drum 112.

The toner image is transferred to the sheet S transmitted to the transfer unit, and the sheet S with the transferred toner image is conveyed to a fixing unit 114. The fixing unit 114 heats and presses the sheet S, thereby permanently fixing an unfixed transferred image on the sheet S. The sheet with the fixed image is ejected from the main body 101 to a paper output tray 119 by a discharge roller 116.

Figure 2:
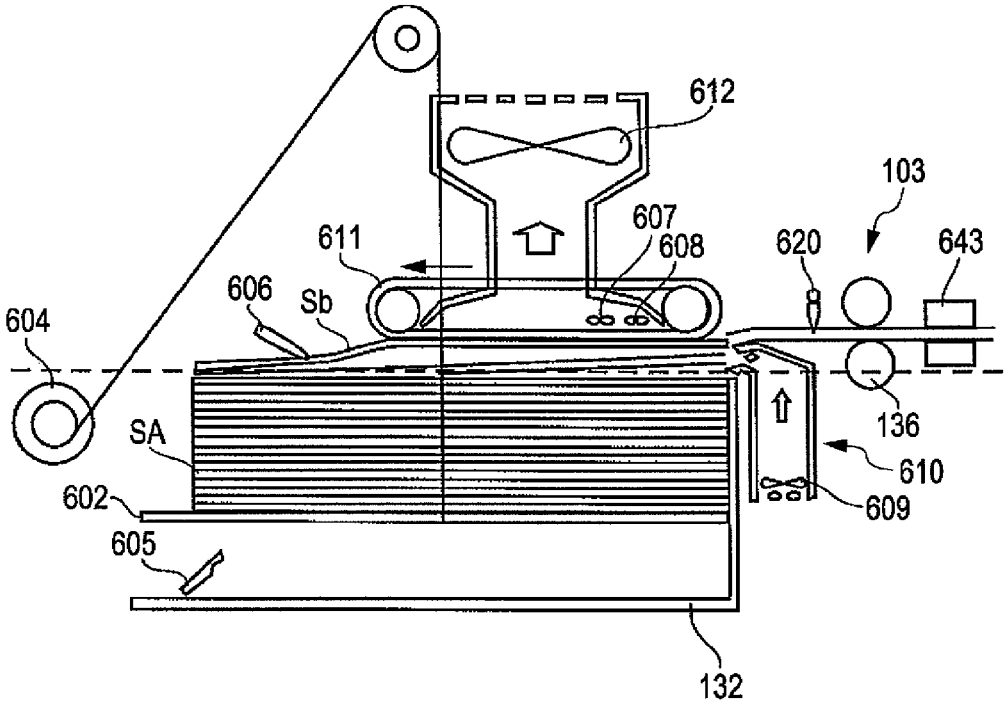
FIG. 2 illustrates a structure of a sheet feeding device provided in the image forming apparatus illustrated in FIG. 1.

FIG. 2 illustrates a structure of the sheet feeding device 103. In FIG. 2, a raisable and lowerable tray 602 for accommodating a sheet stack SA thereon is provided in a repository 132 in the sheet storage unit 115. A lifter 604 is configured to raise and lower the tray 602. A lower position sensor 605 is a position sensor that detects the tray 602 in the repository 132. A paper presence sensor 606 is configured to detect the presence or absence of sheets placed on the tray 602.

Figure 4A:
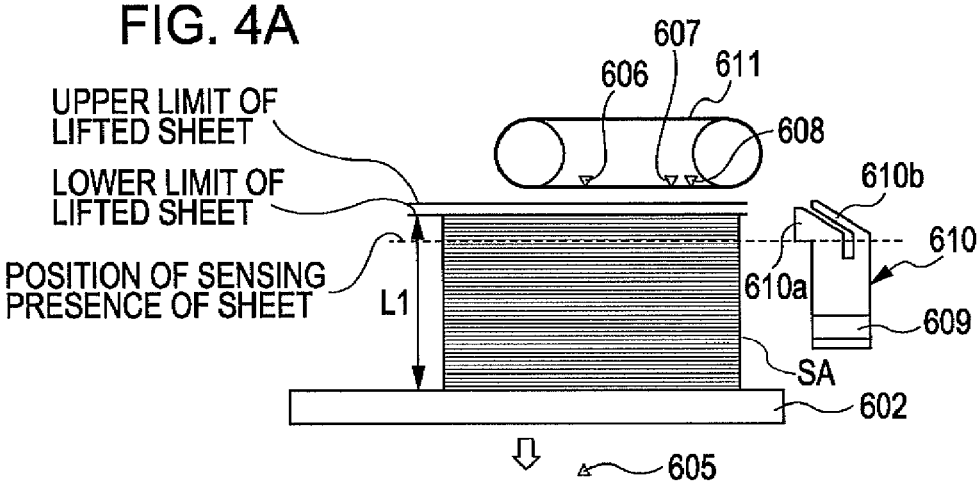
FIGS. 4A to 4C illustrate how the quantity of air of a loosening fan illustrated in FIG. 2 is adjusted.
Figure 13:
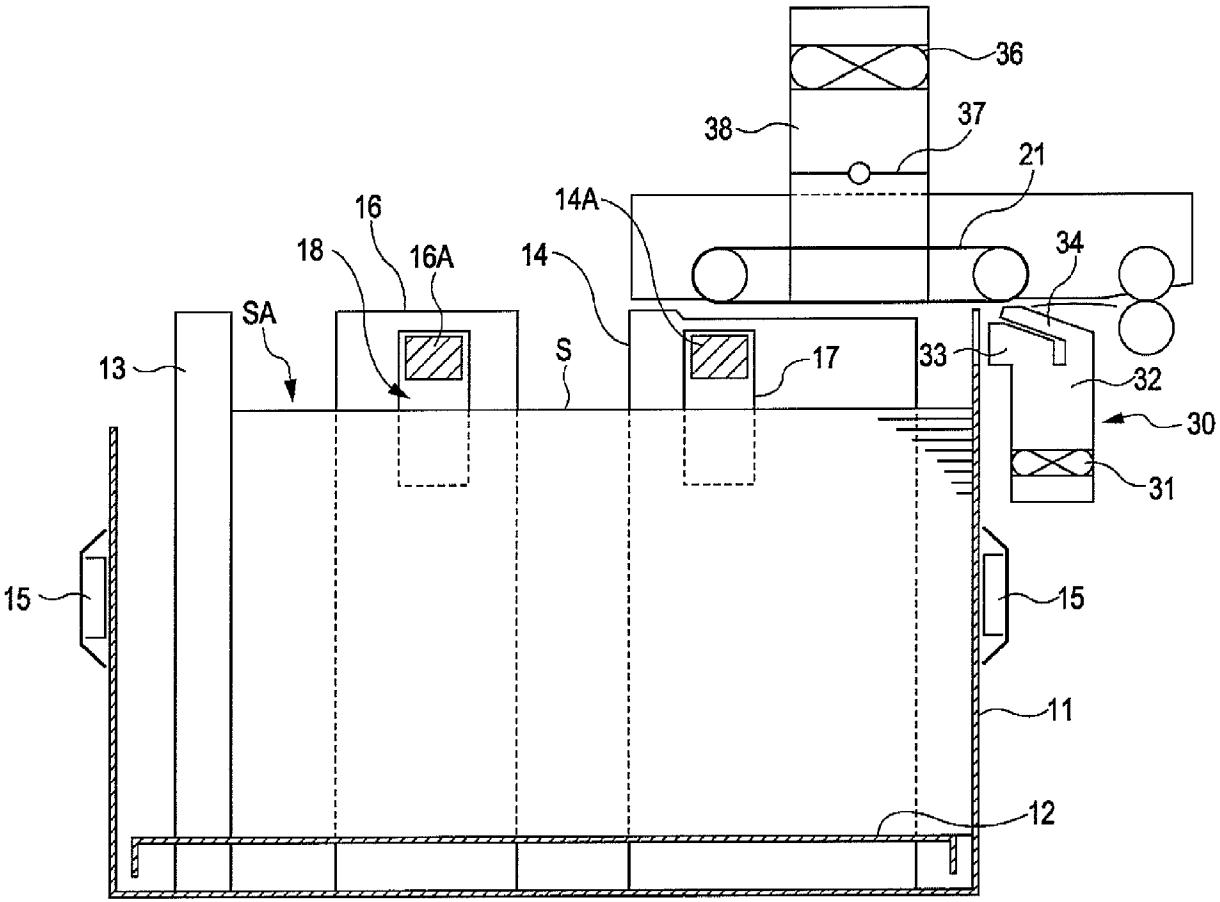
FIG. 13 PRIOR ART
FIG. 13 illustrates a schematic structure of a sheet feeding device provided in a known image forming apparatus.
Figure 14:
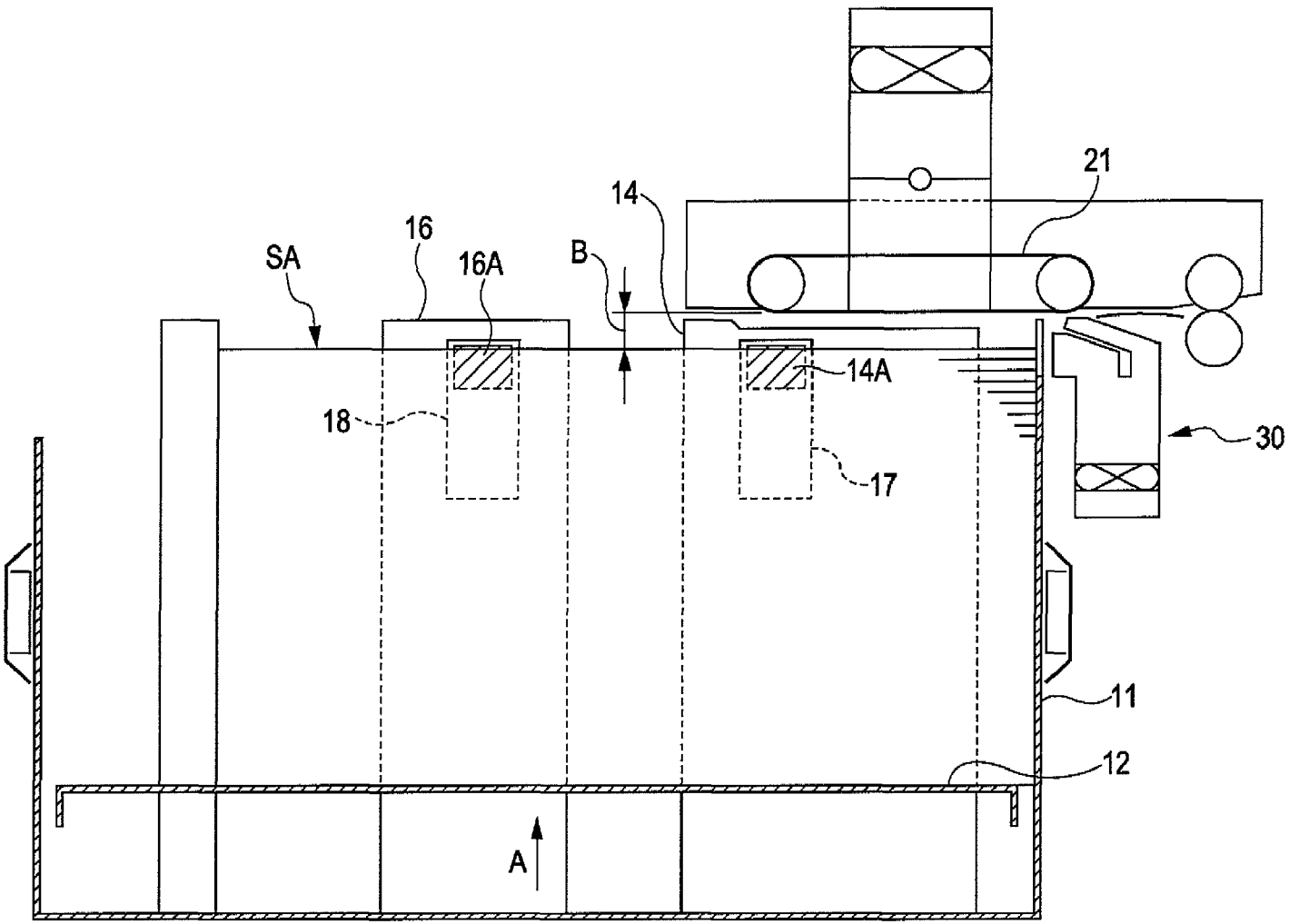
FIG. 14 PRIOR ART
FIG. 14 illustrates a sheet feeding operation performed by the sheet feeding device illustrated in FIG. 13.
Figure 15:
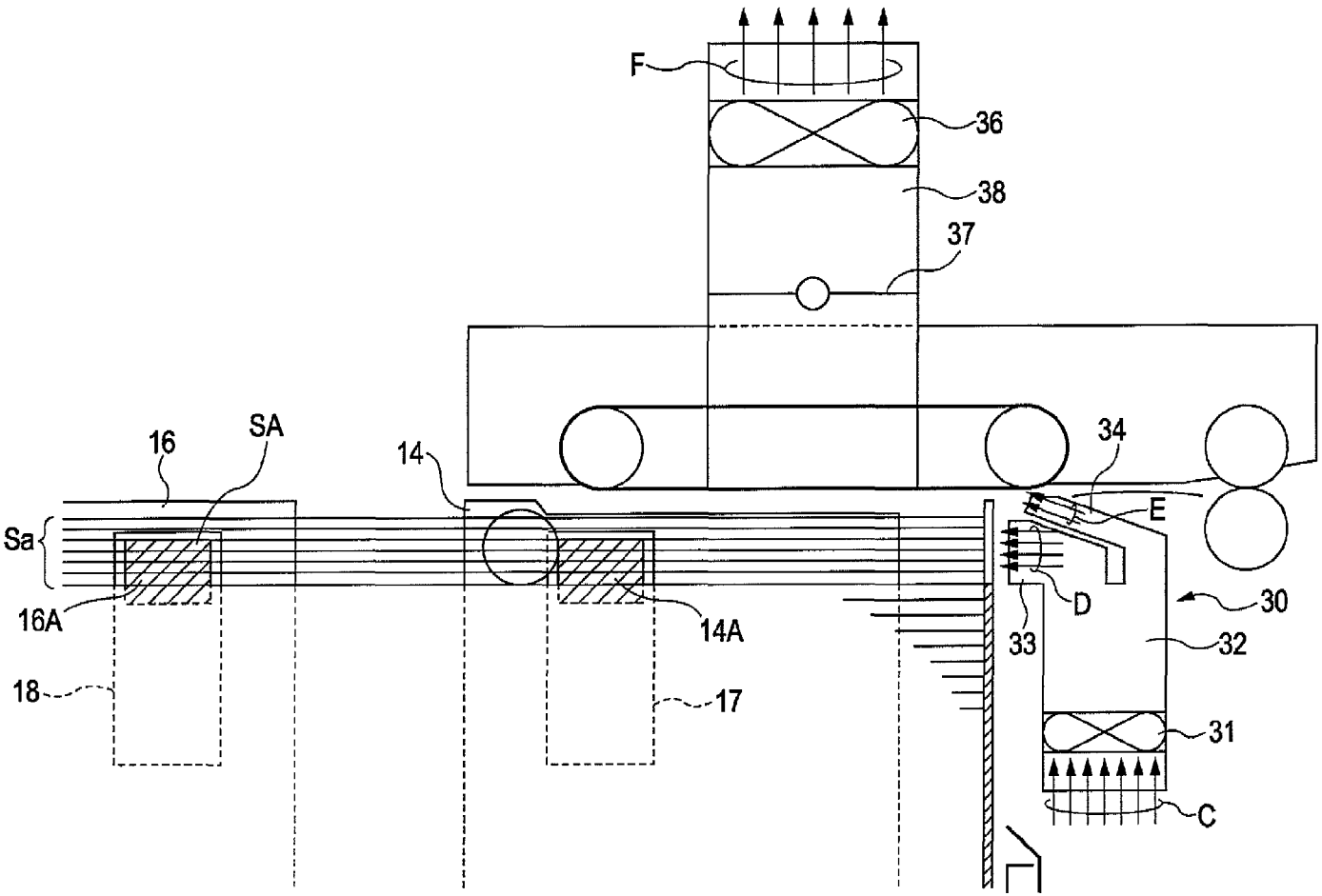
FIG. 15 PRIOR ART
FIG. 15 illustrates the sheet feeding operation performed by the sheet feeding device illustrated in FIG. 13.
Figure 16:
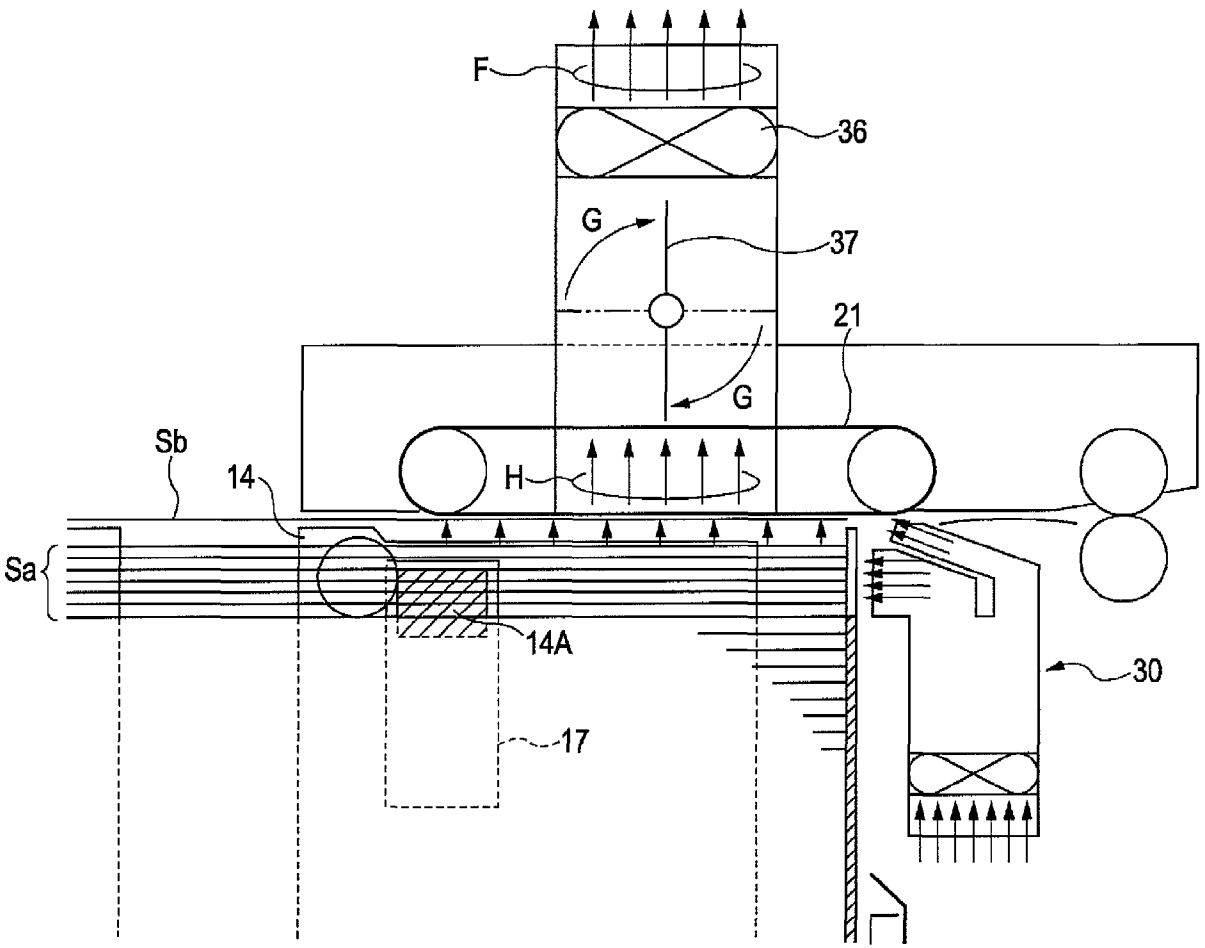
FIG. 16 PRIOR ART
FIG. 16 illustrates the sheet feeding operation performed by the sheet feeding device illustrated in FIG. 13.
Figure 17:
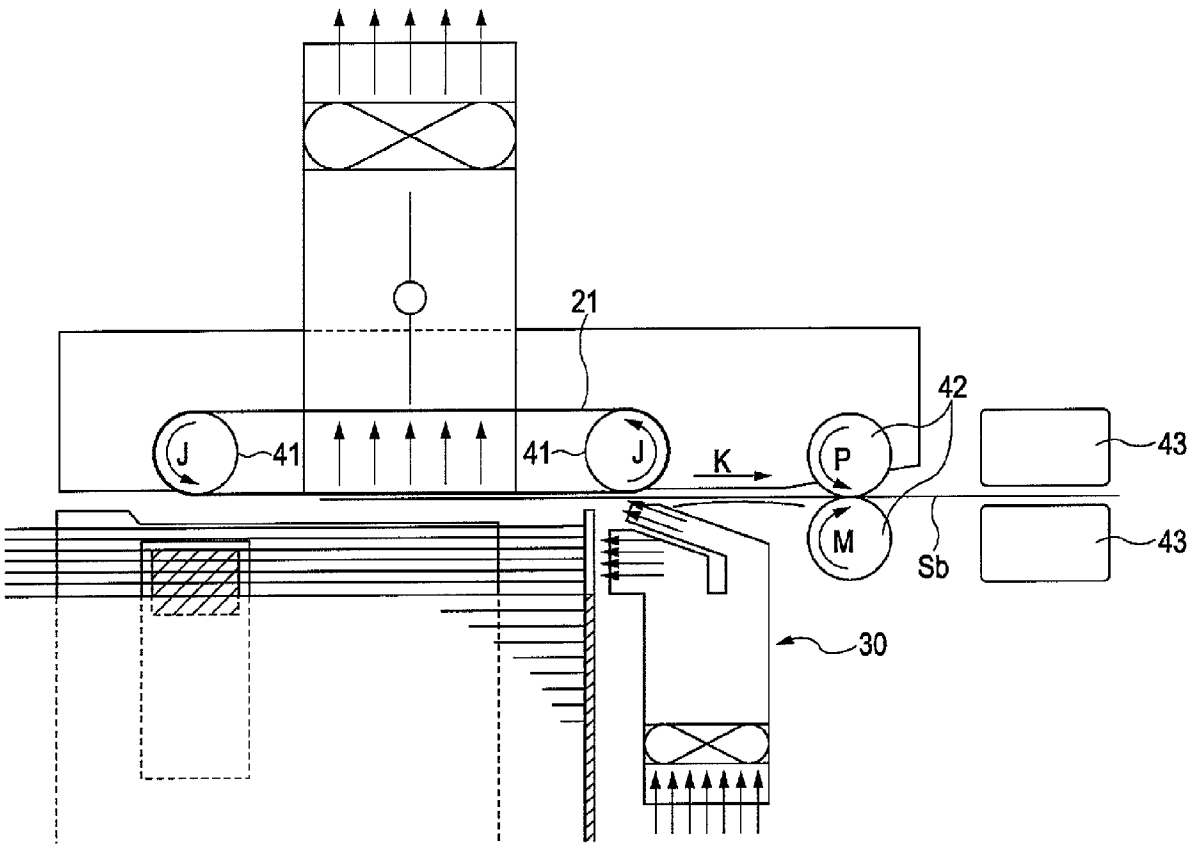
FIG. 17 PRIOR ART
FIG. 17 illustrates the sheet feeding operation performed by the sheet feeding device illustrated in FIG. 13.

The suction conveying belt 611 is configured to convey a sheet while holding the sheet thereon by suction. A suction fan 612 is configured to generate a negative pressure for causing a sheet to be held on the suction conveying belt 611 by suction. An air blowing unit 610 is configured to blow air on a downstream (front) end of the sheet stack SA in the sheet feed direction, i.e., the leading-end face. The air blowing unit 610 includes a loosening fan 609, a loosening nozzle 610*a*, and a separation nozzle 610*b*, both of which are illustrated in FIG. 4A. The sheet feeding device in the present embodiment can include the auxiliary separation fans 17 and 18 provided on the side-end regulators 14 and 16, respectively, as illustrated in FIG. 13.

A lift lower limit sensor 607 and a lift upper limit sensor 608, which will be described below, are disposed above the sheet stack SA on the tray 602. A retry sensor 620 operates such that, if the retry sensor 620 does not detect a sheet over a predetermined time period after the reception of a feed signal, the sheet feeding device performs a sheet feed operation again.

With respect to the sheet feeding device 103, which has the above-described structure, a user draws the repository 132 provided in the sheet storage unit 115 out from the main body 101 toward the near side of the drawing in FIG. 2 and places the sheet stack SA thereon. After the user returns the repository 132 into the main body 101, the tray 602, which is a sheet stacking unit, is raised by the lifter 604. The tray 602 stops at a position where the distance between the top surface of the sheet stack SA and the suction conveying belt 611 is equal to a predetermined distance and waits for reception of a feed signal.

In response to an input of the feed signal, the loosening fan 609 operates and blows air toward the leading end of the sheet stack SA through the loosening nozzle 610*a* and the separation nozzle 610*b*. Therefore, several sheets are lifted and the sheet stack SA is loosened.

When a predetermined period of time has elapsed from the input of the feed signal and the lift of the several sheets has become stable, the suction force from the suction fan 612 causes the topmost sheet Sb among the lifted several sheets to be held on the suction conveying belt 611.

The suction conveying belt 611 is rotated in a direction indicated by the arrow, thereby feeding the sheet Sb together with the rotation of the suction conveying belt 611. Subsequently, the sheet Sb is conveyed to a downstream conveying path by a pair of drawing rollers 136.

In FIG. 2, a multi-feed detection unit 643 is configured to detect a multi-feed condition (a situation in which a plurality of stacked sheets is conveyed at a time). The multi-feed detection unit 643 can include two ultrasonic sensors for transmitting and receiving ultrasonic waves. The two ultrasonic sensors are disposed above and below the conveying path, respectively. The multi-feed detection unit 643 can detect whether a multi-feed condition is occurring on the basis of a reception level of ultrasonic waves irradiated through one or more sheets passing through the conveying path by the second ultrasonic sensor after having been transmitted from the first ultrasonic sensor.

Figure 3:
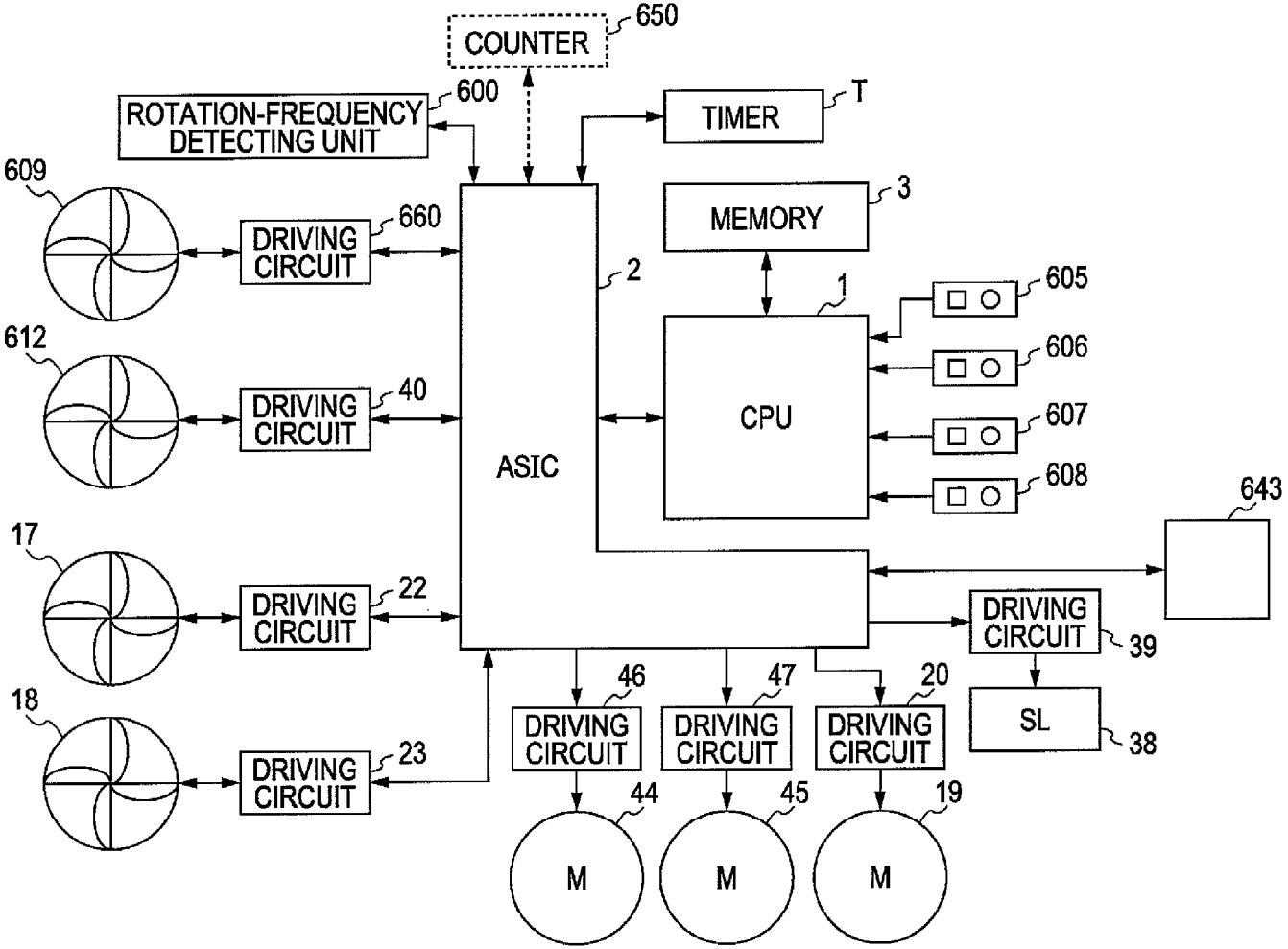
FIG. 3 is a control block diagram of the sheet feeding device provided in the image forming apparatus illustrated in FIG. 1.

FIG. 3 is a control block diagram of the sheet feeding device 103. A central processing unit (CPU) 1 is configured to control the sheet feeding device 103. The CPU 1 is connected to an application-specific integrated circuit (ASIC) 2, which controls various components of the sheet feeding device 103 (e.g., motors and fans), and a memory 3, which is a storage unit, for storing target and PWM values for use in adjustment of a fan.

The CPU 1 is also connected to the lower position sensor 605, the paper presence sensor 606, the lift lower limit sensor 607, and the lift upper limit sensor 608.

The ASIC 2 is configured to issue an instruction to a driving circuit to start driving each of the various components of the sheet feeding device 103. The ASIC 2 also performs pulse width modulation (PWM) control so as to cause the fan to rotate at a target rotation frequency in response to reception of a rotation-frequency signal (FG) for each of the loosening fan 609 and the suction fan 612. The ASIC 2 is connected to, in addition to the auxiliary separation fans 17 and 18 (see FIG. 13), the multi-feed detection unit 643. Therefore, the ASIC 2 determines on the basis of information from the multi-feed detection unit 643 whether a multi-feed condition is occurring.

In FIG. 3, a driving circuit 660 is configured to transmit a PWM signal output from the ASIC 2 to the loosening fan 609 and to supply power thereto. Similarly, a driving circuit 40 is configured to transmit a PWM signal output from the ASIC 2 to the suction fan 612 and to supply power thereto. Driving circuits 22 and 23 are configured to switch on and off the auxiliary separation fans 17 and 18, respectively.

A driving circuit 39 is configured to drive a solenoid (SL) 38 for opening and closing the suction shutter 37 (see FIG. 13). A driver IC 46 is configured to drive a paper feed motor 44 for driving the suction conveying belt 611. A driver IC 47 is configured to drive a drawing motor 45 for driving the pair of drawing rollers 136. A driving circuit 20 is configured to drive a lifter motor 19, which is a lifter driving unit, for raising and lowering the tray 602. In the present embodiment, the various loads of the sheet feeding device 103 (e.g., motors and fans) are controlled by the dedicated ASIC 2. Alternatively, the various loads can be controlled by the CPU 1.

Figure 4B:
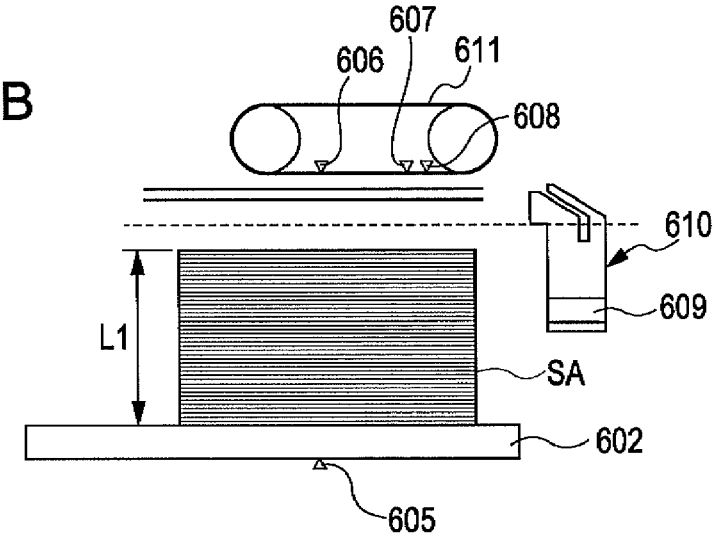
Figure 4C:
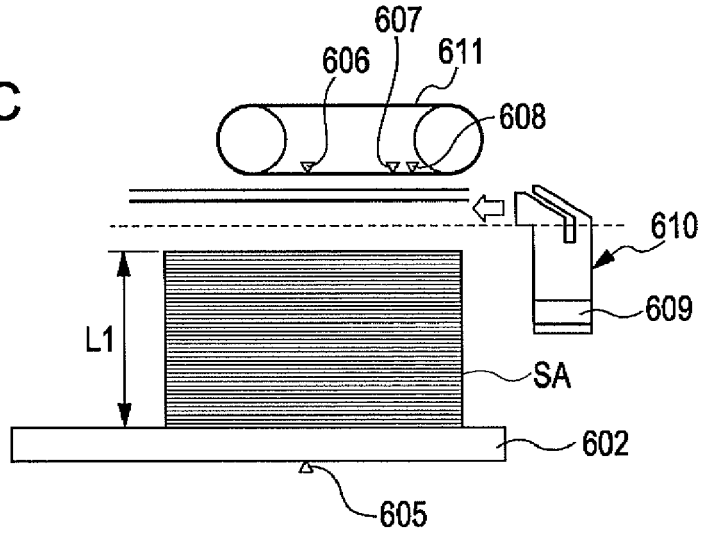

Next, a method for adjusting the quantity of air supplied by the loosening fan 609 in the sheet feeding device 103 will be described with reference to FIGS. 4A to 4C. After power is turned on, after a predetermined number of sheets are conveyed by the sheet feeding device 103, or after a predetermined time period has elapsed, when a transition signal that indicates shifting to a rotation-speed control mode for the loosening fan 609 is detected, rotation-speed control for adjusting the quantity of air supplied by the loosening fan 609 starts.

In order to appropriately perform the rotation-speed control, no obstacle in front of the loosening nozzle 610*a*, which is an air outlet of the loosening fan 609, is required. For example, if the sheet stack SA placed on the tray 602 is present in front of the loosening nozzle 610*a*, the channel of air supplied from the loosening fan 609 is blocked. Therefore, an appropriate rotation frequency, quantity of air, and air pressure cannot be obtained.

To avoid this, when the transition signal is detected, the ASIC 2 (CPU 1), illustrated in FIG. 3, first drives the lifter motor 19. This starts an operation of lowering the tray 602 by the lifter 604 (see FIG. 2), as illustrated in FIG. 4A. Then, as illustrated in FIG. 4B, when the lower position sensor 605 detects the tray 602, the driving of the lifter motor 19 is stopped and the tray 602 is stopped. When, in this state, a sheet is not detected by the paper presence sensor 606, the loosening fan 609 is driven so as to blow air, as illustrated in FIG. 4C, and, after a predetermined time period elapses, the rotation-speed control for the loosening fan 609 starts.

Next, the rotation-speed control for the loosening fan 609 will be described with reference to FIGS. 5A to 5C. Generally, for a fan that can monitor a rotation frequency, a target value is necessary for controlling the rotation speed of the fan. Therefore, it has been found from the features of the fan that, when the fan is controlled by a predetermined PWM setting, a predetermined rotation frequency (frequency generation (FG)) is output while at the same time a predetermined air pressure is obtained.

For example, as indicated in FIG. 5A, it is assumed that, when the fan operates with a setting of PWM 100%, a rotation frequency (FG) of 600 Hz is output while at the same time a pressure of 1000 Pa is obtained as an air pressure. As indicated in FIG. 5B, if it is assumed that a necessary air pressure for a single fan is 840 Pa, a target value range of the rotation frequency of the fan is set such that the target value is 500 Hz, the upper limit thereof is 502 Hz, and the lower limit thereof is 498 Hz.

When the target values are set, after the fan starts operating, the rotation-speed control for the fan is performed after a lapse of a predetermined period. As a result, a PWM value after the rotation-speed control for the fan is appropriately completed is 90%. The reason for waiting for a lapse of the predetermined period is that it is necessary to wait until the rotation of the fan becomes stable.

In this way, after a predetermined time period has elapsed and the rotation of the fan becomes stable, the rotation-speed control for controlling the rotation frequency of the fan to fall within a target rotation-frequency range between the upper limit and the lower limit, and the PWM value of the fan is changed such that the rotation frequency (FG) of the fan is equal to a predetermined value. Examples of a method for controlling the rotation speed of the fan include a method of rotating the fan with 100% duty and then reducing the PWM value for each predetermined value and a method of increasing or reducing the PWM value by a value in which the difference between a target value and an actual value is multiplied by a coefficient. Alternatively, instead of initially rotating the fan with 100% duty, the fan can be rotated with a predetermined PWM value from the beginning.

For obtaining a stronger air pressure, a plurality of loosening fans (e.g., four) can be connected. In this case, as indicated in FIG. 5C, for example, a target range defined by a target value, an upper limit thereof, and a lower limit thereof is set for each fan, and the rotation frequency of each fan is controlled so as to fall within its target range.

It is assumed that, when first to fourth loosening fans operate with a setting of PWM 100%, a rotation frequency (FG) of 220 Hz is output as the rotation frequency output while at the same time a pressure of 300 Pa is obtained as an air pressure. It is assumed that a necessary air pressure for loosening sheets is 840 Pa.

In this case, as indicated in FIG. 5C, for example, the rotation frequency of the first loosening fan is set to have a target range defined by a target value of 182 Hz, an upper limit of 184 Hz, and a lower limit of 180 Hz. The rotation frequency of the second loosening fan is set to have a target range defined by a target value of 171 Hz, an upper limit of 173 Hz, and a lower limit of 169 Hz. The rotation frequency of the third loosening fan is set to have a target range defined by a target value of 181 Hz, an upper limit of 183 Hz, and a lower limit of 179 Hz. The rotation frequency of the fourth loosening fan is set to have a target range defined by a target value of 162 Hz, an upper limit of 164 Hz, and a lower limit of 160 Hz.

The target values are determined as the optimal values from the results of a study for the structure in the present invention. It is necessary to appropriately set an optimal value as each of the target values and the upper and lower rotation-frequency limits depending on the structures.

Next, an operation occurring after the rotation-speed control for the loosening fan 609 starts will be described with reference to FIGS. 6A and 6B. In the present embodiment, as illustrated in FIG. 3, a rotation frequency measuring unit 600 configured to measure the rotation frequency of the loosening fan 609 is disposed. Upon starting of the rotation-speed control for the loosening fan 609, the ASIC 2 (CPU 1), which is a determining unit, starts a timer T and determines whether the rotation frequency of the loosening fan 609 falls within a target rotation-frequency range, as indicated in FIG. 5B, before a predetermined time period elapses. When four loosening fans are used, the ASIC 2 (CPU 1) determines whether each of the first to fourth loosening fans falls within a target rotation-frequency range, as indicated in FIG. 5C, before a predetermined time period elapses.

When the rotation frequency of the loosening fan 609 falls within the target rotation-frequency range before the predetermined time period elapses from the starting of the rotation-speed control for the loosening fan 609, the rotation-speed control for the loosening fan 609 is completed and the loosening fan 609 is stopped.

Figure 6A:
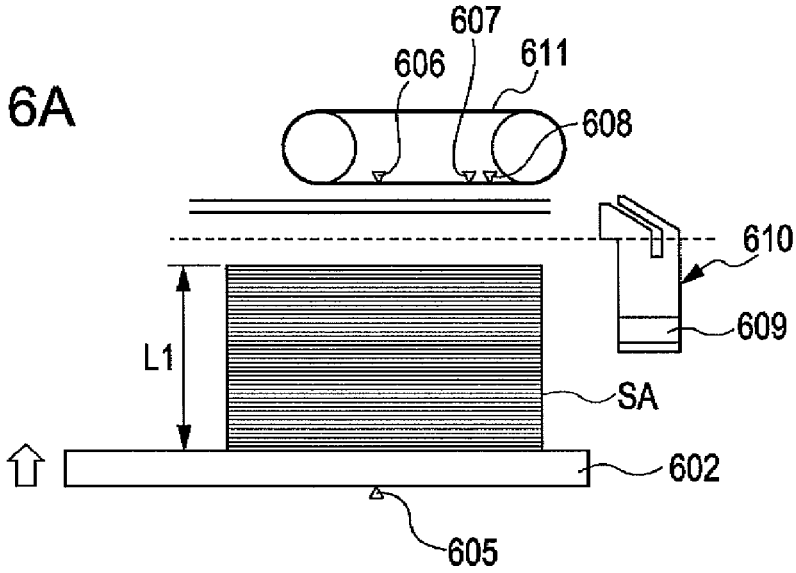
FIGS. 6A and 6B illustrate operations occurring after the control of the rotation-speed control for the loosening fan illustrated in FIG. 2 starts.
Figure 6B:
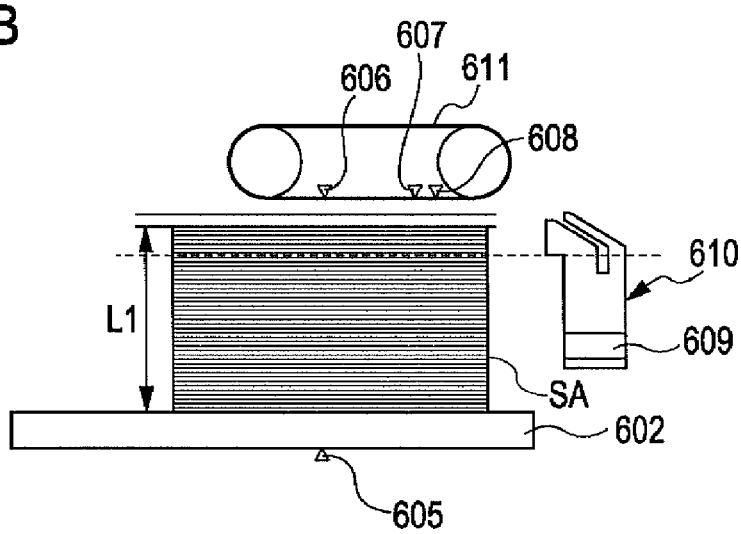

After the tray 602 is raised by the lifter 604 and the top surface of the sheets placed on the tray 602 is detected by the lift lower limit sensor 607, as illustrated in FIG. 6A, the lifter 604 is stopped, as illustrated in FIG. 6B. Instead of stopping the tray 602 in response to a signal from the lift lower limit sensor 607 after the tray 602 is raised, the tray 602 may be stopped in response to a signal from the paper presence sensor 606 or the lift upper limit sensor 608. Therefore, the sheet feeding device 103 is shifted to a stand-by state and is ready for starting a paper feed operation in response to reception of a paper-feed start signal whenever necessary.

When the paper-feed start signal is input after the sheet feeding device 103 is in the stand-by state, the loosening fan 609 is first driven to lift several sheets in a sheet stack. Subsequently, the suction force generated by the suction fan 612 causes the topmost sheet Sb in the lifted sheets to be held on the suction conveying belt 611, as illustrated in FIG. 2. Then, the rotation of the suction conveying belt 611 feeds the sheet Sb. After that, the drawing rollers 136 convey the sheet Sb to the next conveying path.

The sheet Sb fed in this way passes through the multi-feed detection unit 643. At this time, when the multi-feed detection unit 643 detects that a multi-feed condition is occurring, an adjustment mode for adjusting the loosening fan 609 to obtain a PWM value at which the quantity of air that enables a sheet to be fed without causing a multi-feed condition is obtainable is performed. In the present embodiment, when a multi-feed condition occurs, the sheets in the multi-feed condition are ejected to a placement tray used for multi-feed conditions (escape tray), not shown, disposed in a branch from the upstream side of the image forming unit without having to stop the printer 100.

Figure 7:
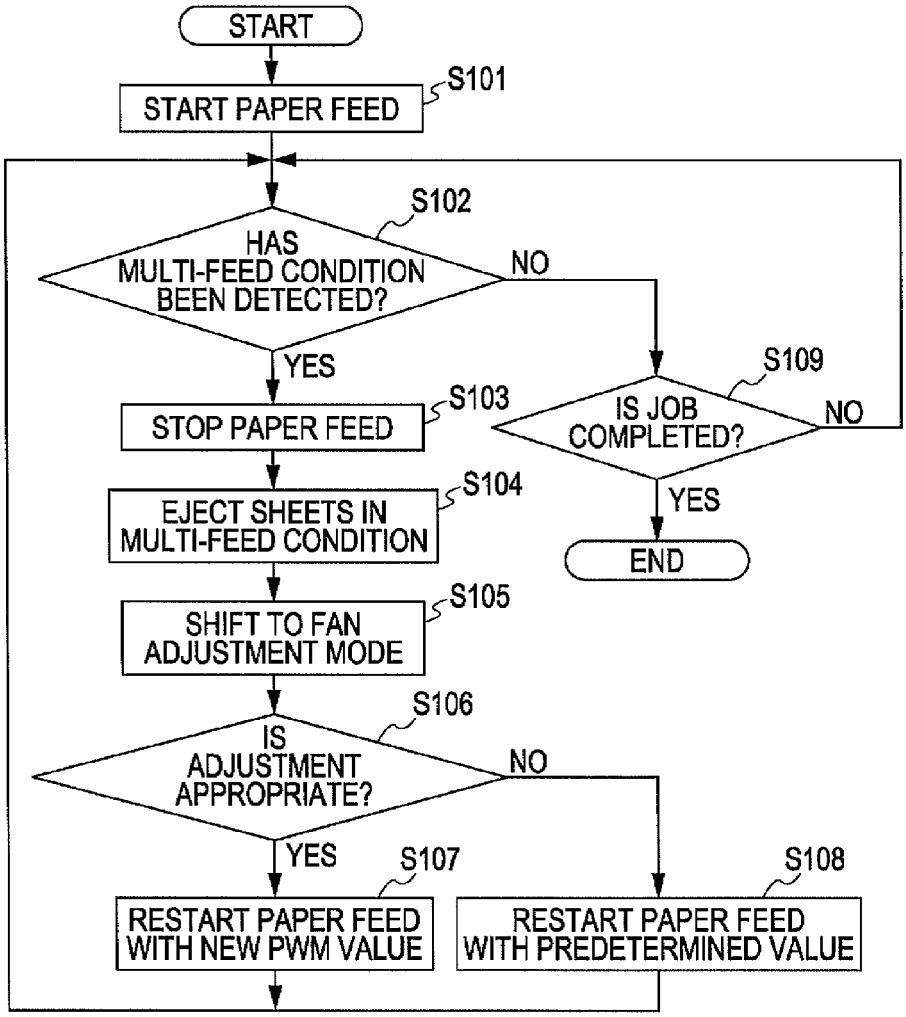
FIG. 7 is a flowchart illustrating a fan adjustment mode for the loosening fan illustrated in FIG. 2 when a multi-feed condition is detected.

Next, such a fan adjustment mode occurring when a multi-feed condition is detected will be described with reference to the flowchart of FIG. 7. First, in step S101, a paper feed operation of feeding a sheet from the repository 132 starts. In step S102, the multi-feed detection unit 643 disposed on the sheet conveying path monitors whether a multi-feed condition is occurring. If the multi-feed detection unit 643 detects the occurrence of a multi-feed condition (YES in step S102), flow proceeds to step S103, where the paper feed operation of feeding a sheet from the repository 132 is stopped. Then, in step S104, the sheets in the multi-feed condition are ejected to the placement tray used for multi feed conditions (not shown).

Next, in step S105, the sheet feeding device 103 shifts to the adjustment mode for the loosening fan, and the rotation-speed control, described above, is performed. In step S106, it is determined whether the adjustment in the fan adjustment mode has been appropriately completed and a new PWM value at which the rotation frequency (FG) of the loosening fan 609 is equal to a predetermined value has been obtained. If the adjustment in the fan adjustment mode has been appropriately completed and a new PWM value has been obtained (YES in step S106), flow proceeds to step S107, where the loosening fan 609 is rotated with the new PWM value and the paper feed operation of feeding a sheet from the repository 132 is restarted.

If, in step S106, the adjustment in the fan adjustment mode has not been appropriately completed because of, for example, a breakdown of the loosening fan 609 and thus a new PWM value has not been obtained (NO in step S106), flow proceeds to step S108, where the loosening fan 609 is rotated with a predetermined value previously stored in the memory 3 and the paper feed operation of feeding a sheet from the repository 132 is restarted.

After the loosening fan 609 is rotated with a predetermined value previously stored in the memory 3 and the paper feed operation of feeding a sheet from the repository 132 is restarted, flow returns to step S102, where it is monitored whether a multi-feed condition is occurring. If a multi-feed condition is not detected (NO in step S102), flow proceeds to step S109, where it is determined whether a job has been completed. If the job has not been completed, flow returns to step S102. Monitoring whether a multi-feed condition is occurring continues until the job is completed (YES in step S109).

In this way, when a multi-feed condition is detected, the rotation frequency of the loosening fan 609 is adjusted such that an air pressure that enables sheets to be loosened is obtainable. This can prevent a multi-feed condition from repeatedly occurring in a job. Therefore, a stable sheet transportation state can be maintained. For a job subsequent to a job associated with a detected multi-feed condition, the loosening fan 609 is controlled with an adjusted rotation frequency.

In the present embodiment, the loosening fan is adjusted by PWM control. Alternatively, the loosening fan can be adjusted by applied voltage control, which varies power supply voltage applied to the loosening fan.

In this case, the ASIC 2 illustrated in FIG. 3 performs the applied voltage control such that the loosening fan is rotated at a target rotation frequency. Each of the driving circuits 660 and 40 varies power supply voltage applied to the fan depending on an applied-voltage control signal from the ASIC 2 and supply the voltage to the fan.

Figure 8:
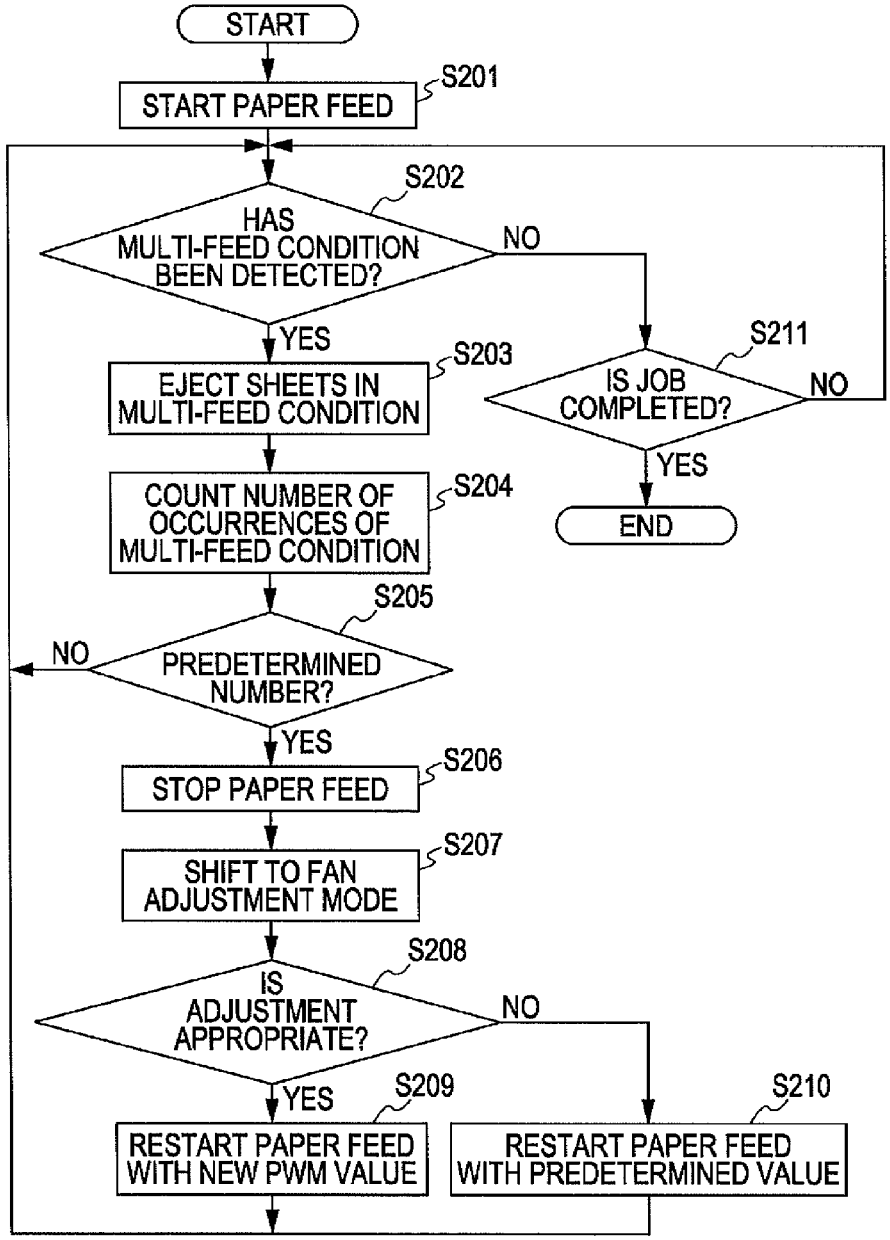
FIG. 8 is a flowchart illustrating a fan adjustment mode when a multi-feed condition is detected according to a second embodiment.

Next, a second embodiment will now be described below. FIG. 8 is a flowchart illustrating a fan adjustment mode when a multi-feed condition is detected according to the present embodiment. The structure of the sheet feeding device 103 is the same as in the first embodiment. The different points will be described in greater detail with reference to the structure.

In the present embodiment, first, in step S201, a paper feed operation of feeding a sheet from the repository 132 starts. In step S202, the multi-feed detection unit 643 disposed on the sheet conveying path monitors whether a multi-feed condition is occurring. If the multi-feed detection unit 643 detects the occurrence of a multi-feed condition (YES in step S202), flow proceeds to step S203, where sheets in the multi-feed condition are ejected to the placement tray used for multi-feed conditions (not shown). In step S204, a counter 650, illustrated in FIG. 3, counts the number of occurrences of a multi-feed condition.

Then, in step S205, it is determined whether the number of occurrences of a multi-feed condition has reached a predetermined number. If the number of occurrences has reached the predetermined number (YES in step S205), flow proceeds to step S206, where the paper feed operation of feeding a sheet from the repository 132 is stopped. If, in step S205, the number of occurrences has not reached the predetermined number (NO in step S205), flow returns to step S202, where the paper feed operation continues and monitoring of the occurrence of a multi-feed condition continues.

After the paper feed operation of feeding a sheet from the repository 132 is stopped, flow proceeds to step S207, where the sheet feeding device 103 shifts to the fan adjustment mode. In step S208, it is determined whether the adjustment in the fan adjustment mode has been appropriately completed and a new PWM value at which the rotation frequency (FG) of the loosening fan 609 is equal to a predetermined value has been obtained.

If, in step S208, the adjustment in the fan adjustment mode has been appropriately completed and a new PWM value has been obtained (YES in step S208), flow proceeds to step S209, where the loosening fan 609 is rotated with the new PWM value and the paper feed operation of feeding a sheet from the repository 132 is restarted. If, in step S208, the adjustment in the fan adjustment mode has not been appropriately completed because of, for example, a breakdown of the loosening fan 609 and thus a new PWM value has not been obtained (NO in step S208), flow proceeds to step S210, where the loosening fan 609 is rotated with a predetermined value previously stored in the memory 3 and the paper feed operation of feeding a sheet from the repository 132 is restarted.

After the loosening fan 609 is rotated with a predetermined value previously stored in the memory 3 and the paper feed operation of feeding a sheet from the repository 132 is restarted, flow returns to step S202, where it is monitored whether a multi-feed condition is occurring. If a multi-feed condition is not detected (NO in step S202), flow proceeds to step S211, where it is determined whether a job has been completed. If the job has not been completed, flow returns to step S202. Monitoring whether a multi-feed condition is occurring continues until the job is completed (YES in step S211).

As described above, according to the present embodiment, when the count of occurrences of a multi-feed condition is equal to a set value, even if a job is being processed, the sheet feeding device 103 is temporarily stopped and the adjustment mode for the loosening fan 609 is performed. Therefore, without causing a problem in which a multi-feed condition occurs very frequently and the sheet feeding device 103 has difficulty in maintaining an appropriate quantity of air for loosening sheets, the sheet feeding device 103 can loosen sheets by an appropriate quantity of air. This can reduce the occurrence of multi-feed conditions.

Figure 9:
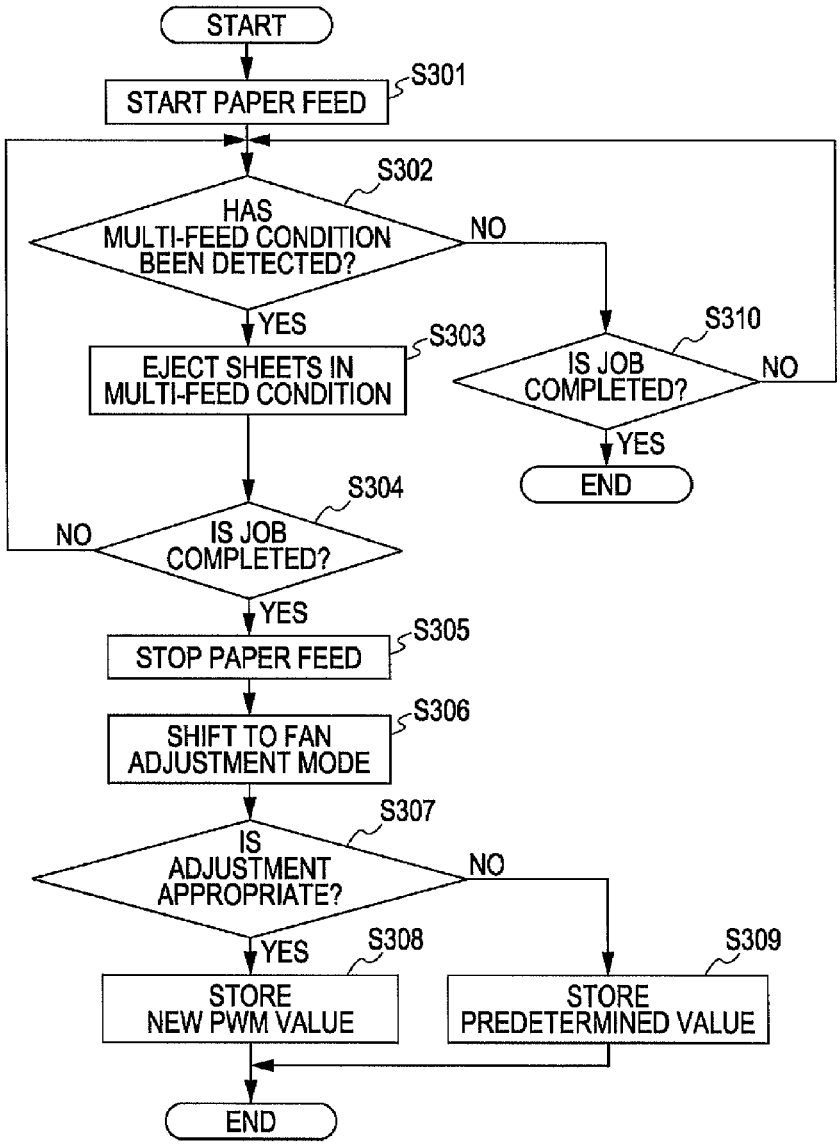
FIG. 9 is a flowchart illustrating a fan adjustment mode when a multi-feed condition is detected according to a third embodiment.

Next, a third embodiment will now be described below. FIG. 9 is a flowchart illustrating a fan adjustment mode when a multi-feed condition is detected according to the present embodiment. The structure of the sheet feeding device is the same as in the first embodiment. The different points will be described in greater detail with reference to the structure.

In the present embodiment, first, in step S301, a paper feed operation of feeding a sheet from the repository 132 starts. In step S302, the multi-feed detection unit 643 disposed on the sheet conveying path monitors whether a multi-feed condition is occurring. If the multi-feed detection unit 643 detects the occurrence of a multi-feed condition (YES in step S302), flow proceeds to step S303, where sheets in the multi-feed condition are ejected to the placement tray used for multi-feed conditions (not shown). In the present embodiment, even after the sheets in the multi-feed condition are ejected to the placement tray used for multi-feed conditions (not shown), the paper feed operation continues while monitoring whether a next multi-feed condition is occurring (through NO in step S304) until the job is completed.

If the job has been completed (YES in step S304), flow proceeds to step S305, where the paper feed operation of feeding a sheet from the repository 132 is stopped and caused to be completed. Then, flow proceeds to step S306, where the sheet feeding device 103 shifts to the fan adjustment mode. In step S307, it is determined whether the adjustment in the fan adjustment mode has been appropriately completed and a new PWM value has been obtained.

If the adjustment in the fan adjustment mode has been appropriately completed and a new PWM value has been obtained (YES in step S307), flow proceeds to step S308, where the new PWM value is stored into the memory 3 illustrated in FIG. 3 to prepare for a next job. If, in step S307, the adjustment in the fan adjustment mode has not been appropriately completed because of, for example, a breakdown of the loosening fan 609 and thus a new PWM value has not been obtained (NO in step S307), flow proceeds to step S309, where a predetermined value previously retained in the memory 3 is stored and flow is completed.

As described above, according to the present embodiment, when a multi-feed condition is detected, the fan adjustment mode for the loosening fan 609 is performed after a job is completed. This can reduce the occurrence of multi-feed conditions with respect to subsequent jobs.

Figure 10:
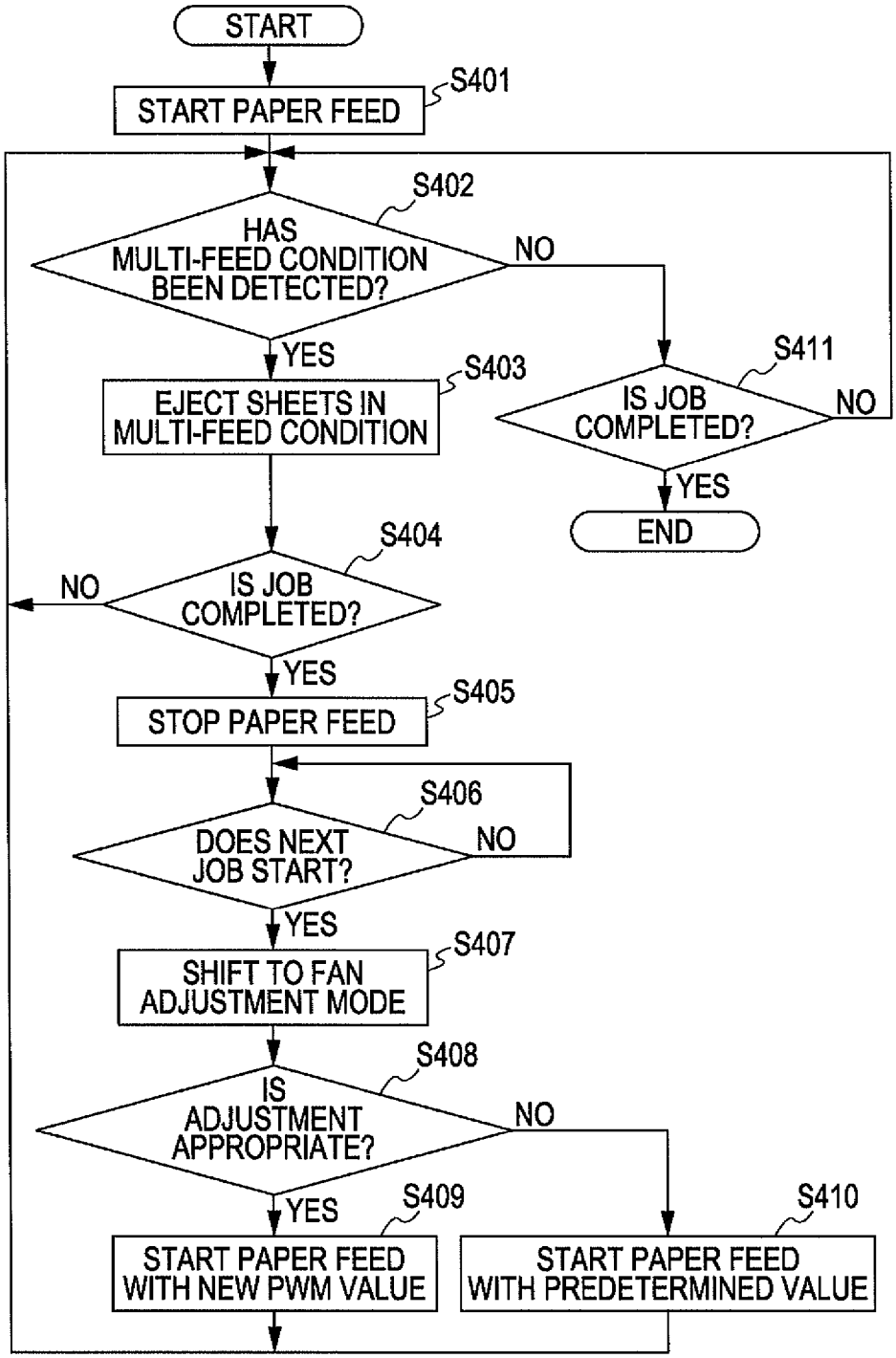
FIG. 10 is a flowchart illustrating a fan adjustment mode when a multi-feed condition is detected according to a fourth embodiment.

Next, a fourth embodiment will now be described below. FIG. 10 is a flowchart illustrating a fan adjustment mode when a multi-feed condition is detected according to the present embodiment. The structure of the sheet feeding device is the same as in the first embodiment. The different points will be described in greater detail with reference to the structure.

In the present embodiment, first, in step S401, a paper feed operation of feeding a sheet from the repository 132 starts. In step S402, the multi-feed detection unit 643 disposed on the sheet conveying path monitors whether a multi-feed condition is occurring. If the multi-feed detection unit 643 detects the occurrence of a multi-feed condition (YES in step S402), flow proceeds to step S403, where sheets in the multi-feed condition are ejected to the placement tray used for multi-feed conditions (not shown). In the present embodiment, even after the sheets in the multi-feed condition are ejected to the placement tray used for multi-feed conditions, the paper feed operation continues while monitoring whether a next multi-feed condition is occurring (through NO in step S404) until the job is completed.

If the job has been completed (YES in step S404), flow proceeds to step S405, where the paper feed operation of feeding a sheet from the repository 132 is stopped and caused to be completed. Then, flow proceeds to step S406, where it is monitored whether a next job is to start (a next job signal has been received). If the next job signal has been received and the next job is to start (YES in step S406), flow proceeds to step S407, where the sheet feeding device 103 shifts to the fan adjustment mode before the paper feed operation for the next job starts. Then, in step S408, it is determined whether the adjustment in the fan adjustment mode has been appropriately completed and a new PWM value has been obtained.

If the adjustment in the fan adjustment mode has been appropriately completed and a new PWM value has been obtained (YES in step S408), flow proceeds to step S409, where the loosening fan 609 is rotated with the new PWM value and the paper feed operation of feeding a sheet from the repository 132 is started. If, in step S408, the adjustment in the fan adjustment mode has not been appropriately completed because of, for example, a breakdown of the loosening fan 609 and thus a new PWM value has not been obtained (NO in step S408), flow proceeds to step S410, where the loosening fan 609 is rotated with a predetermined value previously stored in the memory 3 and the paper feed operation of feeding a sheet from the repository 132 is started.

After the loosening fan 609 is rotated with a predetermined value previously stored in the memory 3 and the paper feed operation of feeding a sheet from the repository 132 is started, flow returns to step S402, where it is monitored whether a multi-feed condition is occurring. If a multi-feed condition is not detected (NO in step S402), flow proceeds to step S411, where it is determined whether a job has been completed. If the job has not been completed, flow returns to step S402. Monitoring whether a multi-feed condition is occurring continues until the job is completed (YES in step S411).

As described above, according to the present embodiment, when a multi-feed condition is detected, the fan adjustment mode for the loosening fan 609 is performed before a next job starts. This can reduce the occurrence of multi-feed conditions with respect to subsequent jobs, as in the third embodiment.

Figure 11:
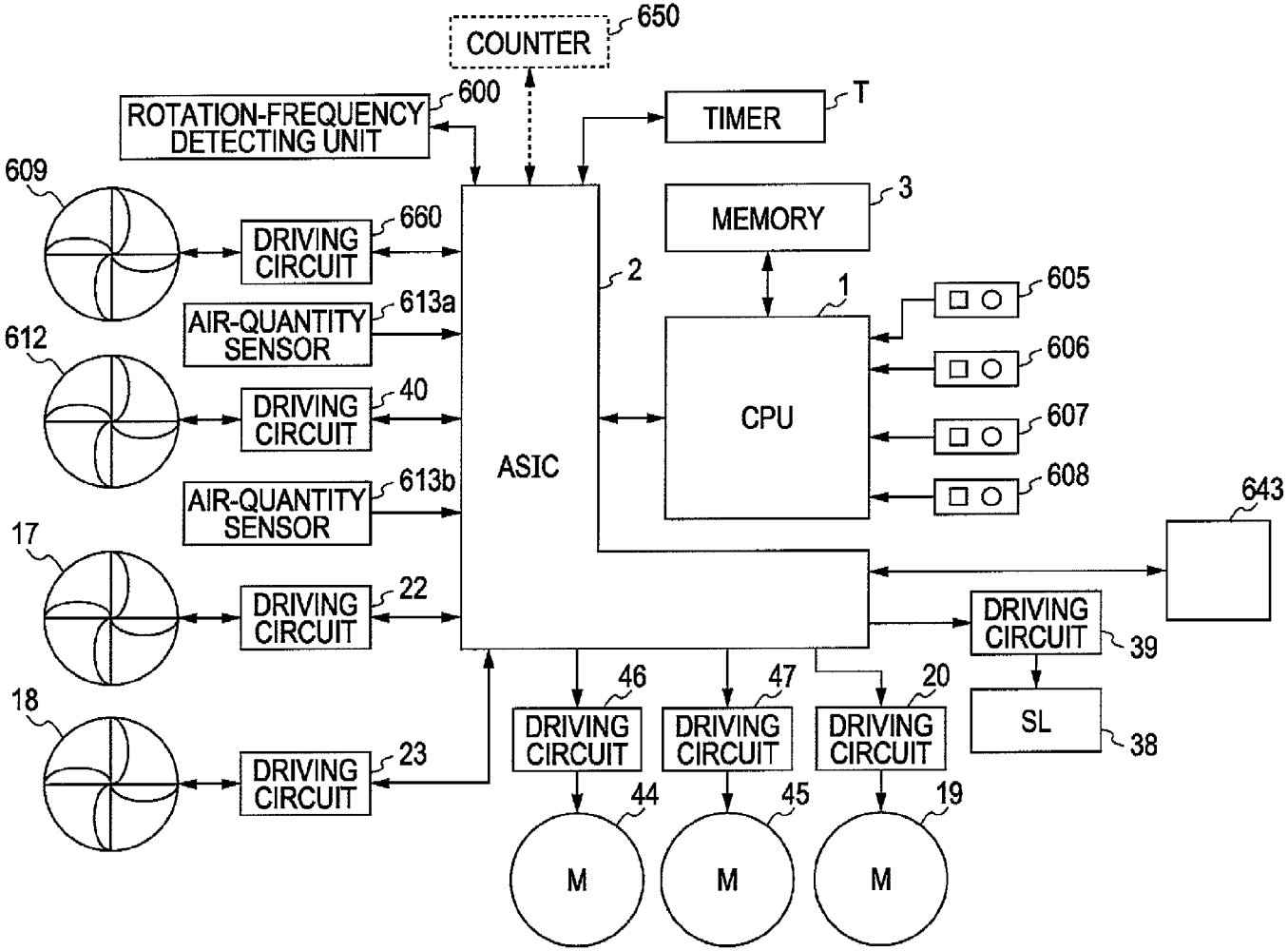
FIG. 11 is a control block diagram of a sheet feeding device according to a fifth embodiment.

Next, a fifth embodiment will now be described below. FIG. 11 is a control block diagram of a sheet feeding device according to the present embodiment. In FIG. 11, the same reference numerals as in FIG. 3 indicate the same or corresponding elements. The structure of the sheet feeding device is the same as in the first embodiment. The different points will be described in greater detail with reference to the structure.

In FIG. 11, air-quantity sensors 613*a* and 613*b* measure the quantity of air supplied by the loosening fan 609 and that by the suction fan 612, respectively. Each of the air-quantity sensors 613*a* and 613*b* is an airflow measuring unit. The air-quantity sensors 613*a* and 613*b* are disposed adjacent to the loosening fan 609 and the suction fan 612, respectively.

The air-quantity sensors 613*a* and 613*b* are connected to the ASIC 2, and measured data on the quantity of air is transmitted to the ASIC 2. The ASIC 2, which is a determining unit, determines on the basis of a signal from the air-quantity sensors 613*a* and 613*b* (data on the quantity of air) whether the quantity of air supplied by the loosening fan 609 falls within a predetermined target air-quantity range at which an air pressure that enables sheets to be loosened is obtainable.

When the ASIC 2 determines that the quantity of air supplied by the loosening fan 609 does not fall within the target air-quantity range, the ASIC 2 performs PWM control such that the loosening fan 609 rotates so as to supply the quantity of air falling within the target air-quantity range, as in the first embodiment.

As described above, according to the present embodiment, when a multi-feed condition is detected by the multi-feed detection unit, the fan adjustment mode for the loosening fan 609 is performed such that the quantity of air measured by each of the air-quantity sensors 613*a* and 613*b* falls within a predetermined target air-quantity range. This enables sheets to be loosened with an appropriate quantity of air and thus can reduce the occurrence of multi-feed conditions.

That is, when a multi-feed condition is detected, the quantity of air supplied by the loosening fan is adjusted such that an air pressure that enables sheets to be loosened is obtainable. This can prevent a multi-feed condition from repeatedly occurring in a job. Therefore, stable sheet transportation state can be maintained.

In the present embodiment, the loosening fan is adjusted by PWM control. Alternatively, the loosening fan can be adjusted by applied voltage control, which varies power supply voltage applied to the loosening fan. In this case, the ASIC 2 illustrated in FIG. 11 performs the applied voltage control such that the loosening fan is rotated so as to supply a target quantity of air. Each of the driving circuits 660 and 40 varies power supply voltage applied to the fan depending on an applied-voltage control signal from the ASIC 2 and supplies the voltage to the fan.

The fan adjustment according to the present embodiment can be performed any one of after a job is temporarily stopped (first embodiment), depending on the count of occurrences of a multi-feed condition (second embodiment), after a job is completed (third embodiment), and after a next job signal is received (fourth embodiment).

Figure 12:
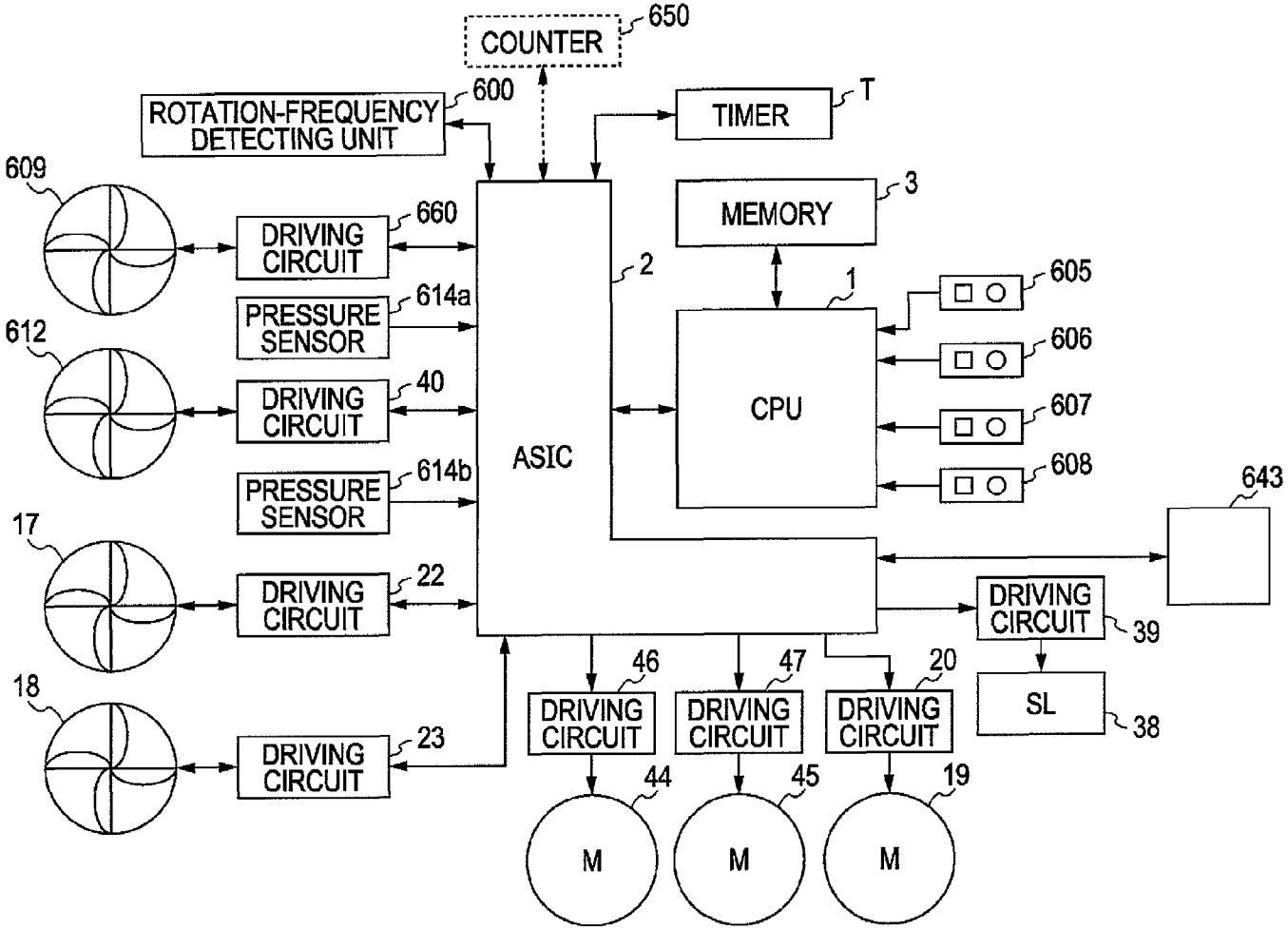
FIG. 12 is a control block diagram of a sheet feeding device according to a sixth embodiment.

Next, a sixth embodiment will now be described below. FIG. 12 is a control block diagram of a sheet feeding device according to the present embodiment. In FIG. 12, the same reference numerals as in FIG. 3 indicate the same or corresponding elements. The structure of the sheet feeding device is the same as in the first embodiment. The different points will be described in greater detail with reference to the structure.

In FIG. 12, pressure sensors 614*a* and 614*b* measure the static pressure supplied by the loosening fan 609 and that by the suction fan 612, respectively. Each of the pressure sensors 614*a* and 614*b* is a pressure measuring unit. The pressure sensors 614*a* and 614*b* are disposed adjacent to the loosening fan 609 and the suction fan 612, respectively.

The pressure sensors 614*a* and 614*b* are connected to the ASIC 2, and measured data on the pressure is transmitted to the ASIC 2. The ASIC 2, which is a determining unit, determines on the basis of a signal from the pressure sensors 614*a* and 614*b* (data on the pressure) whether the static pressure supplied by the loosening fan falls within a predetermined target static-pressure range at which an air pressure that enables sheets to be loosened is obtainable.

When the ASIC 2 determines that the static pressure of the loosening fan 609 does not fall within the target static-pressure range, the ASIC 2 performs PWM control such that the loosening fan 609 rotates with the static voltage falling within the target static-pressure range, as in the first embodiment.

As described above, according to the present embodiment, when a multi-feed condition is detected by the multi-feed detection unit, the fan adjustment mode for the loosening fan 609 is performed such that the static pressure measured by each of the pressure sensors 614*a* and 614*b* falls within a predetermined target static-pressure range. This enables sheets to be loosened with an appropriate quantity of air and thus can reduce the occurrence of multi-feed conditions.

That is, when a multi-feed condition is detected, the static pressure of the loosening fan is adjusted such that an air pressure that enables sheets to be loosened is obtainable. This can prevent a multi-feed condition from repeatedly occurring in a job. Therefore, stable sheet transportation state can be maintained.

In the present embodiment, the loosening fan is adjusted by PWM control. Alternatively, the loosening fan can be adjusted by applied voltage control, which varies power supply voltage applied to the loosening fan. In this case, the ASIC 2 illustrated in FIG. 12 performs the applied voltage control such that the loosening fan is rotated with a target static pressure. Each of the driving circuits 660 and 40 varies power supply voltage applied to the fan depending on an applied-voltage control signal from the ASIC 2 and supplies the voltage to the fan.

The fan adjustment according to the present embodiment can be performed any one of after a job is temporarily stopped (first embodiment), depending on the count of occurrences of a multi-feed condition (second embodiment), after a job is completed (third embodiment), and after a next job signal is received (fourth embodiment).

In the above described embodiments, the loosening fan 609 is adjusted. In addition to or in place of the loosening fan 609, any one of the suction fan 612 and the auxiliary separation fans 17 and 18 (illustrated in FIG. 13) can be adjusted in the same way.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-135893 filed May 15, 2006, which is hereby incorporated by reference herein in its entirety.

What is claimed is:

1. An image forming apparatus comprising:

a tray;

an image forming unit; and a sheet feeding device configured to feed a sheet to the image forming unit after loosening sheets stacked on the tray by blowing air on the sheets, the sheet feeding device comprising:

an air blowing unit including a fan configured to blow air on the sheets stacked on the tray;

a multi-feed detection unit configured to detect a multi-feed condition in which a plurality of sheets are fed at a time;

a rotation-frequency measuring unit configured to measure the rotation frequency of the fan;

a determining unit configured to determine, based on a signal from the rotation-frequency measuring unit, whether the rotation frequency of the fan falls within a predetermined target rotation-frequency range at which an air pressure that enables sheets to be loosened is obtainable; and a control portion configured to control the fan based on a determination by the determining unit, wherein the rotation frequency of the fan is subjected to pulse-width modulation (PWM) control, and during the adjustment of the rotation frequency of the fan, when the determining unit determines that the rotation frequency of the fan does not fall within the target rotation-frequency range, a PWM value of the rotation frequency of the fan is adjusted to a PWM value at which the rotation frequency of the fan falls within the target rotation-frequency range, and the control portion controls the fan to rotate at the adjusted rotation frequency for a feeding job subsequent to a feeding job associated with the detected multi-feed condition.

2. The image forming apparatus according to claim 1, wherein the sheet feeding device is configured to, when the multi-feed detection unit detects a multi-feed condition, stop a feeding job, adjust the rotation frequency of the fan, and then restart the feeding job.

3. The image forming apparatus according to claim 1, wherein the sheet feeding device comprises:

a counting unit configured to count the number of occurrences of a multi-feed condition detected by the multi-feed detection unit, wherein the control portion controls such that the sheet feeding device is configured to, when the multi-feed detection unit detects a multi-feed condition, stop a feeding job depending on a count value counted by the counting unit, adjust the rotation frequency of the fan, and then restart the feeding job.

4. The image forming apparatus according to claim 1, wherein the sheet feeding device is configured to, when the multi-feed detection unit detects a multi-feed condition, adjust the rotation frequency of the fan after completing a feeding job associated with the detected multi-feed condition.

5. The image forming apparatus according to claim 1, wherein the sheet feeding device is configured to, when the multi-feed detection unit detects a multi-feed condition, adjust the rotation frequency of the fan after completing a feeding job associated with the detected multi-feed condition and then receiving a start signal for a next feeding job.

6. The image forming apparatus according to claim 1, wherein the sheet feeding device is configured to adjust the rotation frequency of the fan in a state in which no obstacle is present in front of an air outlet of the air blowing unit.

7. The image forming apparatus according to claim 1, wherein the sheet feeding device comprises:

an airflow measuring unit configured to measure the quantity of air supplied by the fan; and a determining unit configured to determine, on the basis of a signal from the airflow measuring unit, whether the quantity of air supplied by the fan falls within a predetermined target air-quantity range at which an air pressure that enables sheets to be loosened is obtainable, wherein the control portion controls such that the sheet feeding device is configured to, when the determining unit determines that the quantity of air supplied by the fan does not fall within the target air-quantity range, adjust the quantity of air supplied by the fan to fall within the target air-quantity range.

8. The image forming apparatus according to claim 7, wherein the rotation frequency of the fan is subjected to PWM control, and wherein, during the adjustment of the rotation frequency of the fan, when the determining unit determines that the quantity of air supplied by the fan does not fall within the target air-quantity range, a PWM value of the rotation frequency of the fan is adjusted to a PWM value at which the quantity of air supplied by the fan falls within the target air-quantity range.

9. The image forming apparatus according to claim 1, wherein the sheet feeding device comprises:

a pressure measuring unit configured to measure a static pressure supplied by the fan; and a determining unit configured to determine, on the basis of a signal from the pressure measuring unit, whether the static pressure supplied by the fan falls within a predetermined target static-pressure range at which an air pressure that enables sheets to be loosened is obtainable, wherein the sheet feeding device is configured to, when the determining unit determines that the static pressure supplied by the fan does not fall within the target static-pressure range, adjust the static pressure supplied by the fan to fall within the target static-pressure range.

10. The image forming apparatus according to claim 9, wherein the rotation frequency of the fan is subjected to PWM control, and wherein, during the adjustment of the rotation frequency of the fan, when the determining unit determines that the static pressure supplied by the fan does not fall within the target static-pressure range, a PWM value of the rotation frequency of the fan is adjusted to a PWM value at which the static pressure supplied by the fan falls within the target static-pressure range.

* * * * *